US006474995B1

(12) United States Patent
Wu

(10) Patent No.: US 6,474,995 B1
(45) Date of Patent: Nov. 5, 2002

(54) LOW PROFILE RF CONNECTOR AND METHOD OF MANUFACTURING THE RF CONNECTOR

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/021,628

(22) Filed: Oct. 30, 2001

(51) Int. Cl.[7] ..... H01R 12/00
(52) U.S. Cl. ..... 439/63
(58) Field of Search ..... 439/63, 188, 944, 439/736

(56) References Cited

U.S. PATENT DOCUMENTS 5,322,453 A * 6/1994 Resnick et al. ..... 439/63
5,466,160 A * 11/1995 Ogura ..... 439/63
5,807,117 A * 9/1998 Kempf et al. ..... 439/63
5,882,210 A * 3/1999 Embo et al. ..... 439/63
6,113,397 A * 9/2000 Myers ..... 439/63
6,224,390 B1 * 5/2001 Mitani et al. ..... 439/63
6,264,475 B1 * 7/2001 Machado ..... 439/63

* cited by examiner

*Primary Examiner*—Gary F. Paumen
(74) *Attorney, Agent, or Firm*—Wei Te Chung

(57) ABSTRACT

A low profile radio frequency (RF) connector (100) includes a first carrier (4) having a metal shell (2), a second carrier (5) having a center contact (3) with a center pin (30) and an insert molded insulative housing (6). The method for producing such a connector comprises forming metal shells and center contacts on a first and second carriers, positioning the first carrier above the second carrier with the metal shell aligned vertically a corresponding center contact, moving the first and second carriers synchronously, positioning the center pins in a center of the corresponding metal shells from bottom and then insert molding the metal shells and the center contacts with an insulative housing.

1 Claim, 7 Drawing Sheets

LOW PROFILE RF CONNECTOR AND METHOD OF MANUFACTURING THE RF CONNECTOR

FIELD OF THE INVENTION

The present invention generally relates to a radio frequency (RF) connector, and in particular to an RF connector with accurate positioning of a center contact and a metal shell.

BACKGROUND OF THE INVENTION

There is a growing need for low profile radio frequency (RF) connectors for use in mobile electrical devices. Referring to FIG. 7, a conventional RF connector 700 according to U.S. Pat. No. 5,466,160 has a case 701 with four side surfaces and a concavity 702 defined by the side surfaces, an inner conductor 703, an outer conductor 704, a hot-line terminal 705 electrically connecting to the inner conductor 703 and an earth terminal 706 electrically connecting to the outer conductor 704.

However, as the conventional profile RF connector 700 is too small, the inner conductor 703 could not be positioned in the center of the hollow center portion 702 accurately when insert molding the dielectric case 701 to the inner conductor 703 and the outer conductor 704.

Hence, an improved RF connector with better positioning of center contact relative to metal shell is needed to overcome the forgoing shortcomings.

BRIEF SUMMARY OF THE INVENTION

A main object of the present invention is to provide a method for positioning a center contact in a metal shell of a low profile radio frequency (RF) connector accurately during manufacturing.

An RF connector arrangement in accordance with the present invention includes a first carrier having a metal shell, a second carrier having a center contact and a housing. The metal shell has a cylindrical body, a hollow center portion defined by the cylindrical body and two soldering tags extending from a bottom of the cylindrical body. The center contact has a base portion and a center pin extending perpendicularly from the base portion.

The method of making the RF connector is as following: forming a metal shell and a center contact on a first and second carriers; forming the cylindrical body, the hollow center portion, two soldering tags and the connecting portion; forming the center pin and the base portion; positioning the first carrier above the second carrier with the metal shell aligned vertically a corresponding center contact; moving the first carrier and the second carrier synchronously; positioning the center pin in the hollow center portion; insert molding the metal shell and the center contact with an insulative housing; severing the first and second carriers from the metal shell and the center contact.

Other objects, advantages and novel features of the invention will become more apparent from the following detailed description of a preferred embodiment when taken in conjunction with the accompanying drawings.

DETAILED DESCRIPTION OF THE INVENTION

Figure 1:
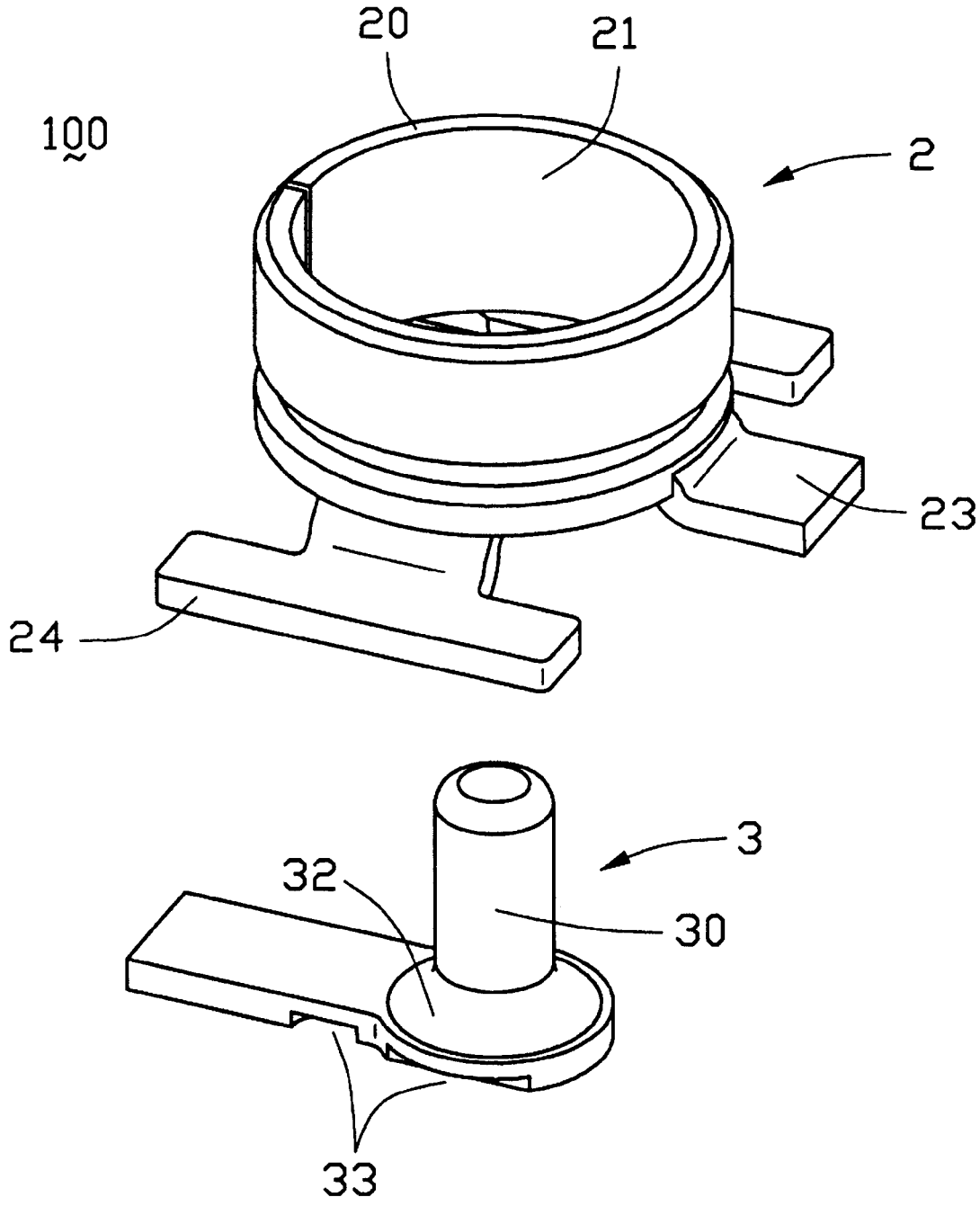
FIG. 1 is an exploded view of a center contact and a metal shell of a radio frequency (RF) connector prior to insert molding a housing according to the present invention.
Figure 2:
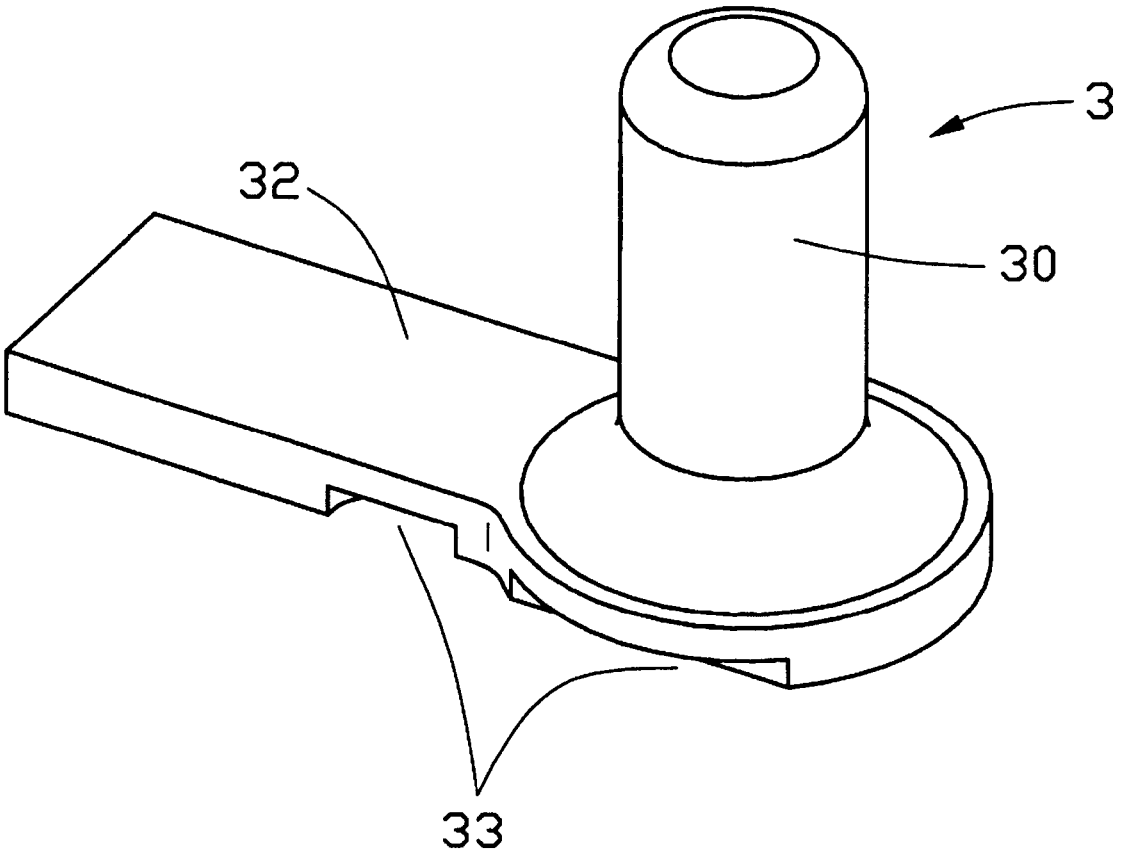
FIG. 2 is a perspective view of the center contact of the RF connector.

Referring to FIGS. 1, 2, 4 and 5, a radio frequency (RF) connector 100 of the invention has a metal shell 2, a center contact 3 and an insulative housing 6. The metal shell 2 is stampingly formed on a first metal carrier 4 to have a cylindrical body 20, two soldering tags 24 extending from a bottom of the cylindrical body 20 and a connecting portion 23 connected to the first carrier 4. The cylindrical body 20 defines a hollow center portion 21.

The center contact 3 is stampingly formed on a second metal carrier 5 to have a base portion 32 and a center pin 30 extending upwardly and perpendicularly from the base portion 32. The base portion 32 is connected to the second carrier 5 at one distal end. Furthermore, a plurality of recesses 33 is defined in bottom edge of the base portion 32 to increase the retention force between the housing 6 and the center contacts 3. The base portion 32 of the center contact 3 is to contact with circuit trace of a printed circuit board (PCB) (not shown).

Figure 5:
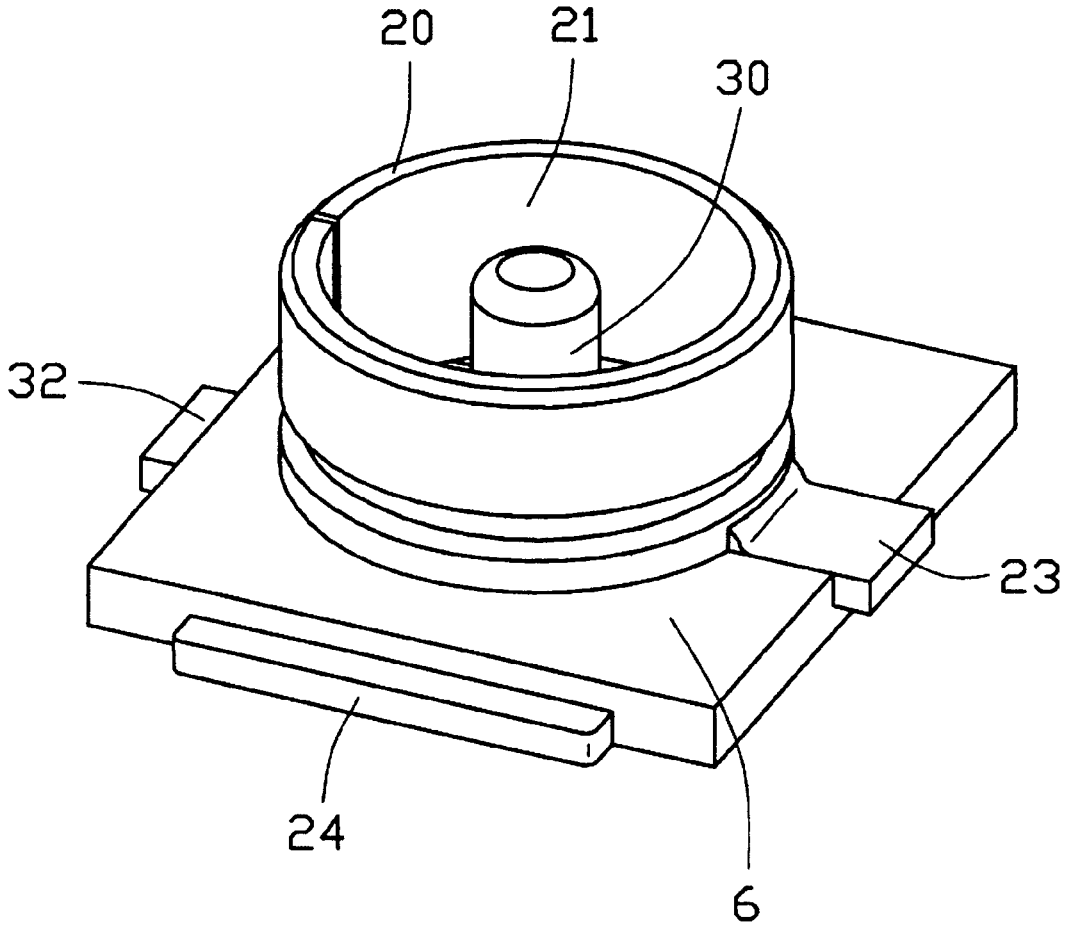
FIG. 5 is an assembled view of the RF connector after insert molding with the housing and severing from the carriers.
Figure 6:
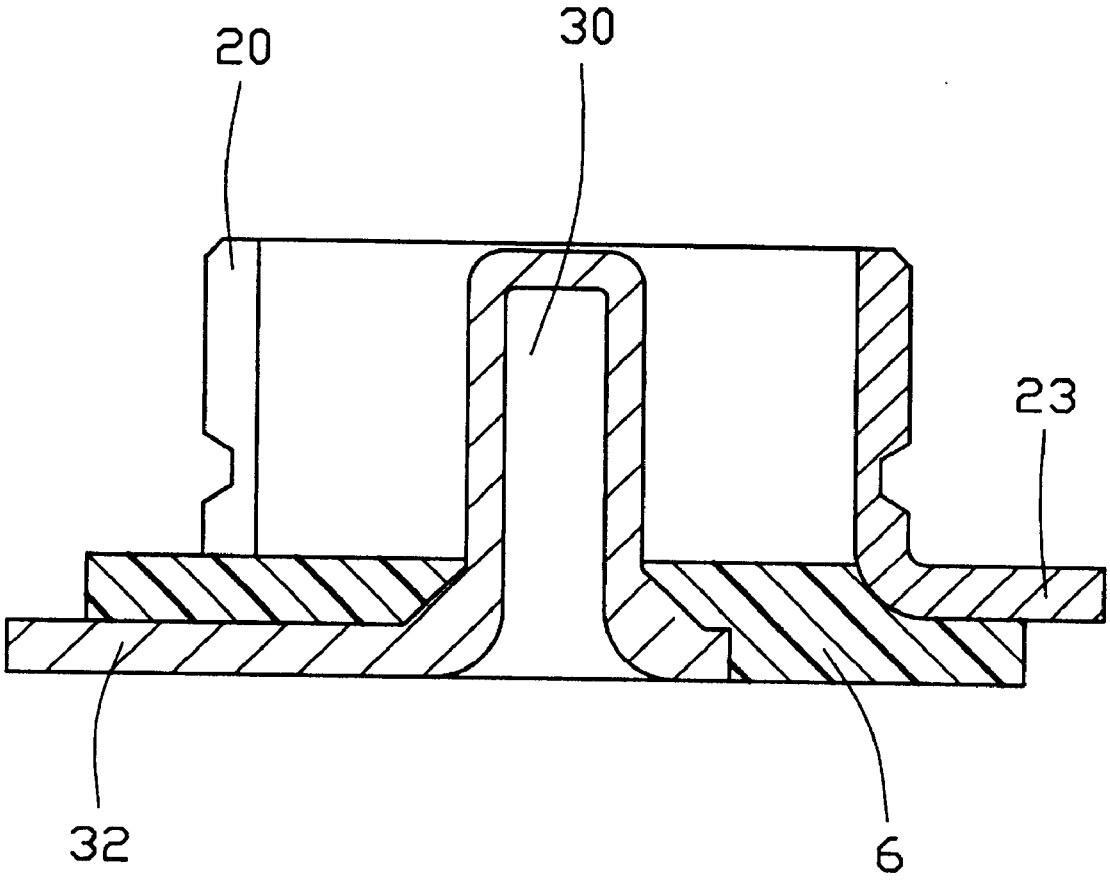
FIG. 6 is a cross-sectional view of the RF connector of FIG. 5.
Figure 7:
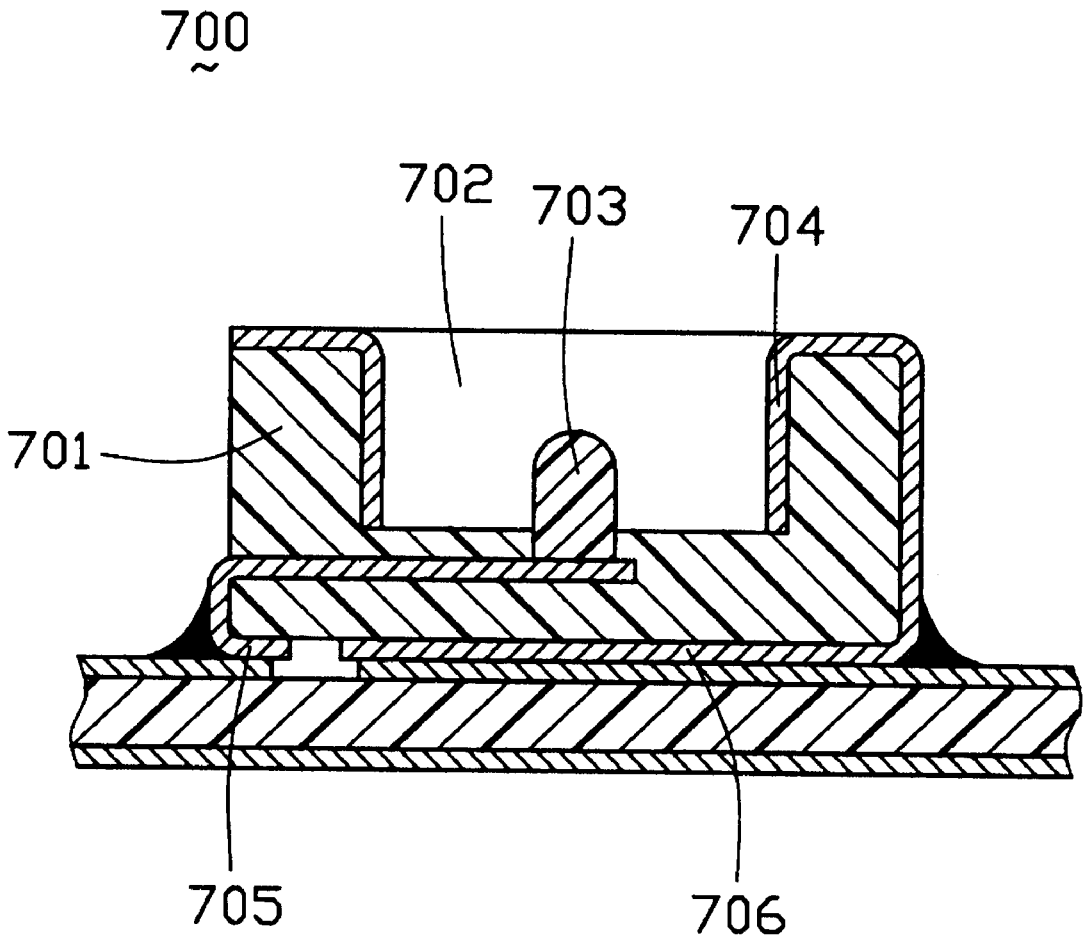
FIG. 7 (PRIOR ART)
FIG. 7 is a cross-sectional view of a conventional RF connector mounted on a substrate.

Referring to FIGS. 5 and 6, the insulative housing 6 is formed by insert molding to respective lower portions of the metal shell 2 and the center contact 3 after the metal shell 2 and the center contact 3 are alignedly positioned relative to each other.

Figure 3:
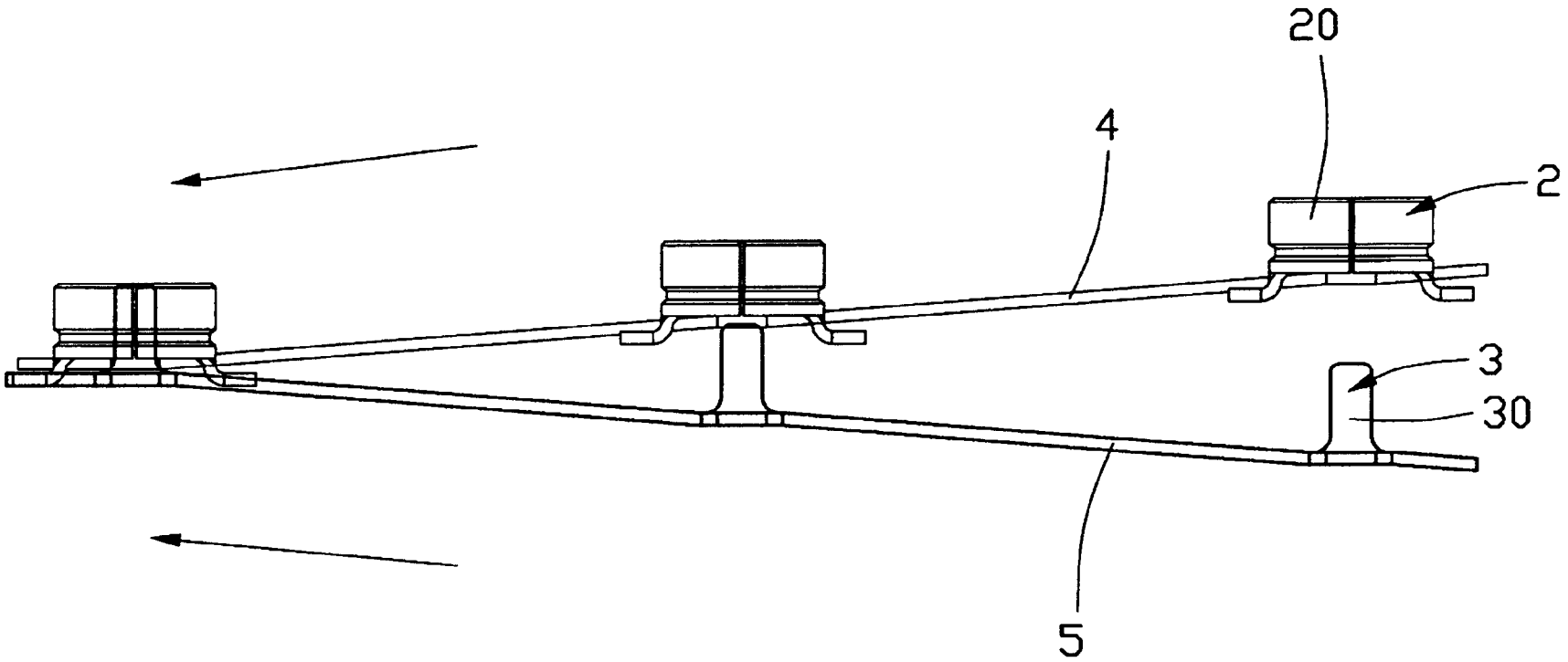
FIG. 3 is a side view showing progressive stages, from right-hand side to left-hand, of positioning the center contact relative to the metal shell of the RF connector.
Figure 4:
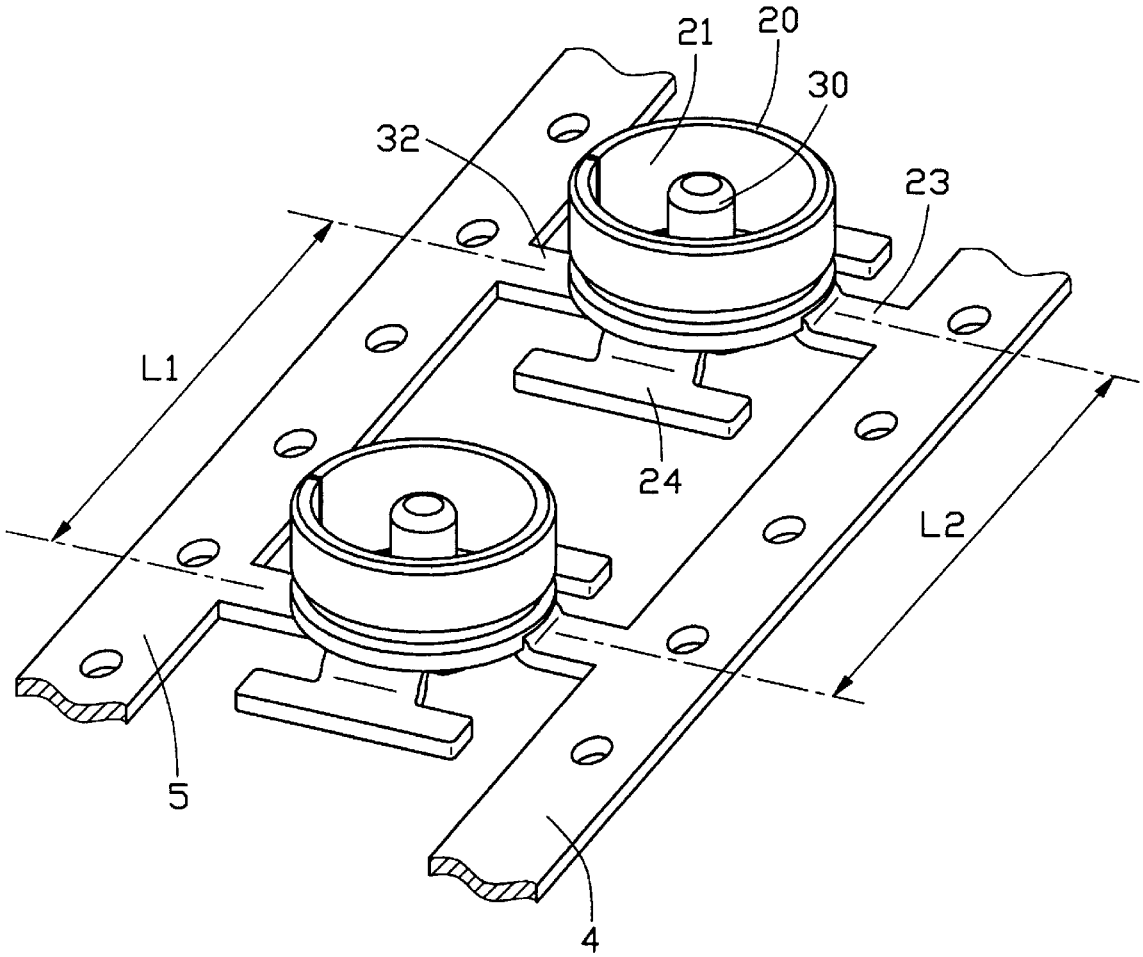
FIG. 4 is a perspective view of the metal shell and the center contact prior to being cut off from individual carrier.

Referring to FIGS. 3 and 4, a method of making the RF connector 100 has following steps:

(a) stamping and bending a plurality of metal shells 2 having the cylindrical body 20 and the hollow center portion 21 defined by the cylindrical body 20 from the first metal carrier 4, wherein every two adjacent metal shells 2 define a first distance or pitch of L1 as measured along the first carrier 4.

(b) Forming two soldering tags 24 extending from a bottom of the cylindrical body 20 and the connecting portion 23 connected to the first carrier 4.

(c) stamping and bending a plurality of center contacts 3 having the center pin 30 and the base portion 32 from the second metal carrier 5, wherein every two adjacent center contacts 3 define a second distance or pitch of L2 as measured along the second carrier 5.

(d) forming the center pin 30 of the center contact 3 to extend perpendicularly from the base portion 32, and defining a plurality of recesses 33 in a bottom of the base portion 32.

(e) the second distance L2 equal to the first distance L1.

(f) positioning the first carrier 4 at a level higher than the second carrier 5 so that each metal shell aligned vertically a corresponding center contact.

(g) conveying the first carrier 4 and the second carrier 5 synchronously and slowing down the first carrier 4 to close up the second carrier 5 at the same time.

(h) positioning the center pin 30 of the center contact 3 in the center of the hollow center portion 21 of the corresponding metal shell 2 from a bottom of the metal shell 2.

(i) insert molding the metal shell 2 and the center contact 3 with an insulative housing 6.

(j) severing the first and second carriers 4, 5 from the metal shell 2 and the center contact 3.

In use, the soldering tags 24 of the metal shell 2 and the base portion 32 of the center contact 3 are soldered to the PCB of an electrical device (not shown). A mating plug (not shown) is inserted into the RF connector 100 for transmitting signals.

It is to be understood, however, that even though numerous, characteristics and advantages of the present invention have been set forth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

I claim:

1. A radio frequency (RF) connector arrangement comprising:

a first carrier including a metal shell, the metal shell having a body and a hollow center portion defined by the body;

a second carrier including a center contact, the center contact having a base portion and a center pin;

the center pin of the center contact being positioned in a center of the hollow center portion of the metal shell; and an insulative housing being insert molded to the center contact and the metal shell;

wherein the body of the metal shell is cylindrical having two soldering tags extending from a bottom of the cylindrical body and a connecting portion connected to the first carrier;

wherein the center pin of the center contact extends perpendicularly from the base portion;

wherein a plurality of recesses are defined in a bottom of the base portion of the center contact.

* * * * *